US008152165B2

(12) United States Patent
Cha et al.

(10) Patent No.: US 8,152,165 B2
(45) Date of Patent: Apr. 10, 2012

(54) APPARATUS FOR TRANSFERRING PAPER MEDIA AND AUTOMATIC TELLER MACHINE HAVING THE SAME

(75) Inventors: Jin Hwan Cha, Gyeonggi-do (KR); Won Joon Lee, Seoul (KR); Young Il Choi, Seoul (KR)

(73) Assignee: Nautilus Hyosung Inc., Seoul (KR)

( * ) Notice: Subject to any disclaimer, the term of this patent is extended or adjusted under 35 U.S.C. 154(b) by 0 days.

(21) Appl. No.: 12/747,879

(22) PCT Filed: Dec. 12, 2008

(86) PCT No.: PCT/KR2008/007354

§ 371 (c)(1),
(2), (4) Date: Jun. 22, 2010

(87) PCT Pub. No.: WO2009/075541

PCT Pub. Date: Jun. 18, 2009

(65) Prior Publication Data

US 2010/0258998 A1 Oct. 14, 2010

(30) Foreign Application Priority Data

Dec. 13, 2007 (KR) ..... 10-2007-0130482

(51) Int. Cl.
*B65H 5/00* (2006.01)

(52) U.S. Cl. ..... 271/264

(58) Field of Classification Search ..... 271/264, 271/275, 198
See application file for complete search history.

(56) References Cited

U.S. PATENT DOCUMENTS

| | | | |
|---|---|---|---|
| 4,146,220 | A | 3/1979 | Barton |
| 5,240,368 | A | 8/1993 | Graef et al. |
| 5,673,333 | A | 9/1997 | Johnston |
| 2005/0184144 | A1 | 8/2005 | Eastman et al. |
| 2005/0284926 | A1 | 12/2005 | Ahn et al. |
| 2007/0164097 | A1 | 7/2007 | Kwak et al. |

FOREIGN PATENT DOCUMENTS

| | | |
|---|---|---|
| JP | 08-1102 | 1/1996 |
| KR | 20-1998-015526 | 6/1998 |
| KR | 20-0157090 | 9/1999 |
| KR | 10-2006-0000772 | 1/2006 |
| KR | 10-2007-0079636 | 8/2007 |
| KR | 10-2007-0081203 | 8/2007 |

OTHER PUBLICATIONS

European Patent Office, Supplementary European Search Report, Patent Application No. EP 08859386.8, May 23, 2011, seven pages.
PCT International Search Report, PCT/KR2008/007354, Jun. 24, 2009, 4 Pages.
PCT Written Opinion of the International Searching Authority, PCT/KR2008/007354, Jun. 24, 2009, 4 Pages.

*Primary Examiner* — David H Bollinger
(74) *Attorney, Agent, or Firm* — Fenwick & West LLP

(57) ABSTRACT

Provided are a paper media transfer device and an automatic teller machine having the same. The paper media transfer device may include: a medium guide portion being provided on one side of a transfer direction of the paper media, and including a guide surface having at least one high point and at least one low point along the transfer direction of the paper media; and a medium transfer portion forming a transfer path of the paper media together with the medium guide portion to transfer the paper media, and including a belt member that is curved in correspondence to the guide surface, and a belt roller that drives the belt member and maintains the curved shape of the belt member, or adds a tension to the belt. Through this, it is possible to improve a tightening force.

7 Claims, 4 Drawing Sheets

APPARATUS FOR TRANSFERRING PAPER MEDIA AND AUTOMATIC TELLER MACHINE HAVING THE SAME

TECHNICAL FIELD

The present invention relates to a paper media transfer device and an automatic teller machine having the paper media transfer device. More particularly, the present invention relates to a paper media transfer device that includes a belt member on only one side of a transfer path of paper media, and an automatic teller machine having the paper media transfer device.

BACKGROUND ART

An automatic teller machine denotes an automated device that may provide basic financial services such as deposit and withdrawal in association with financial services, without a need of a banking teller and without a restriction on a time and an occasion.

The automatic teller machine may be generally classified into a cash withdrawing device and a cash depositing device according to deposit and withdrawal. Currently, the automatic teller machine is being used for various purposes such as depositing/withdrawing of a check, a bankbook arrangement, depositing of a giro, ticketing, and the like.

Paper media such as cash, checks, and the like may be used for the automatic teller machine. A paper media transfer device may be used to move the paper media.

The conventional paper media transfer device may transfer the paper media using belts that are mounted on its both sides. Specifically, the paper media transfer device may transfer the paper media via a space formed between contact surfaces of the mounted belts.

However, since the conventional paper media transfer device uses a plurality of belts and rollers, it generally has a very complex structure, and its maintenance and repair is difficult. When there occurs a difference between driving speeds of the belts, the paper media may be torn, or be jammed.

Also, when folded paper media or a half size of paper media is received between the belts mounted to both sides of the conventional paper media transfer device, the folded paper media or the half size of paper media may be stuck between the belts and thus may not be effectively transferred.

DISCLOSURE OF INVENTION

Technical Goals

An aspect of the present invention provides a paper media transfer device that may have a simple structure, and be readily repaired and maintained, and an automatic teller machine having the paper media transfer device.

Another aspect of the present invention also provides a paper media transfer device that may have a relatively greater tightening force than a flat transfer path by forming a medium guide portion and a medium transfer portion to be curved, and an automatic teller machine having the paper media transfer device. Here, the medium guide portion and the medium transfer portion constitute the transfer path.

Another aspect of the present invention also provides a paper media transfer device that may alternatively displace a guide rib and a belt making a contact with paper media and thereby prevent a half size of paper media or folded paper media from being suck in a transfer path and thereby not being transferred, and an automatic teller machine having the paper media transfer device.

Technical Solutions

According to an aspect of the present invention, there is provided a paper media transfer device including: a medium guide portion being provided on one side of a transfer direction of the paper media, and including a guide surface having at least one high point and at least one low point along the transfer direction of the paper media; and a medium transfer portion forming a transfer path of the paper media together with the medium guide portion to transfer the paper media, and including a belt member that is curved in correspondence to the guide surface, and a belt roller that drives the belt member and maintains the curved shape of the belt member, or adds a tension to the belt.

As described above, the medium transfer portion capable of giving a motion to the paper media may be provided on one side of the paper media and the motionless medium guide portion may be provided on another side of the paper media based on the paper media. Also, the medium guide portion and the medium transfer portion may be curved along the transfer direction of the paper media. Through this, it is possible to improve a tightening force against the paper media.

Also, since there is no need to use a plurality of belts and belt rollers, a configuration of the paper media transfer device may be simplified. Also, it is possible to improve an internal space utilization of an automatic teller machine and the like including the paper media transfer device. Also, it is possible to improve the convenience of maintenance and repair of the paper media transfer device.

Here, the belt member may include at least two rows of belts that are spaced apart from each other. A plurality of guide ribs may be formed on one surface of the medium guide portion along a moving direction of the belts to thereby be positioned between the belts. The one surface of the medium guide portion may face the belt.

Through the above construction, the plurality of guide ribs may be provided on both sides of the belt. Therefore, even when a half size of paper media or folded paper media is being transferred, a frictional force between any one of the belt and the guide rib, and the paper media may be maintained, and thus the half size of paper media may be effectively transferred.

Also, it is possible to prevent the paper media from being skewed by using, as the belt member, the at least two rows of belts that are spaced apart from each other.

One surface of the belt making a contact with the paper media may form the same surface as a surface connecting end surfaces of the guide ribs, that is, the guide surfaces. Accordingly, an edge of each guide rib and an edge of the belt may increase a force given to the paper media, thereby increasing a tightening force.

Here, since the end surface of the guide rib and the contact surface of the belt form the straight line or the same surface, the paper media may form an approximate wave shape when passing by a space formed between the edge of the guide rib and the edge of the belt.

Also, even when the folded paper media or the half size of paper media is being transferred, a gap may be formed between the edge of the guide rib and the edge of the belt. Therefore, it is possible to prevent the folded paper media or the half size of paper media from being completely tightly stuck between the medium guide portion and the belt. The folded paper media or the half size of paper media may be effectively transferred to a retracting box and the like.

Also, the medium guide portion may include: a plurality of idler reception portions being formed in a portion corresponding to each of the at least one low point along the transfer direction of the paper media; and a plurality of idlers being mounted to the plurality of idler reception portions, respectively. Specifically, each of the idlers may be provided in each low portion or a location corresponding to each of the at least one low point of the medium guide portion. Accordingly, even when a phase of the transfer path of the paper media changes, it is possible to prevent the paper media from being skewed, or being jammed.

Also, the medium guide portion may include a paper media inlet to receive the paper media between the medium transfer portion and the medium guide portion. In this instance, a paper media path guide portion may be further provided on one side of the paper media inlet to guide the paper media to the paper media inlet. This is to transfer the paper media in a state of maintaining a pickup angle or an entrance angle of the paper media passing through a medium separation portion of the automatic teller machine.

The medium guide portion may be formed of a singe plate, and each of the idler reception portions may be a groove or a hole formed in the plate.

Also, the medium guide portion may be formed of a plurality of plates, and at least one of the idler reception portions and the paper media inlet may be a gap formed between the plurality of plates. Through this, it is possible to omit a process of manufacturing a paper media inlet or an idler reception portion.

According to another aspect of the present invention, there is provided an automatic teller machine including: a paper media storage device; a medium separation device separating paper media stored in the paper media storage device; and a paper media transfer device transferring paper media separated in a sheet unit by the medium separation device. The paper media transfer device may include: a medium guide portion being provided on one side of a transfer direction of the paper media, and including a guide surface curved along the transfer direction of the paper media; and a medium transfer portion forming a transfer path of the paper media together with the medium guide portion, and including a belt member that is curved in correspondence to the guide surface.

Here, the medium separation device may be an external-type separation module that is provided outside of the paper media storage device. Through this, it is possible to improve a capability for separating the paper media and to reduce a manufacturing cost of the automatic teller machine.

Also, by driving a pickup roller of the medium separation device via a stepping motor, even when the paper media is being abnormally transferred, for example, when double sheets of paper media are being transferred, it may be effectively processed.

Advantageous Effect

According to embodiments of the present invention, a belt member may be provided only on one side of paper media based on a transfer direction of the paper media, and the belt member may be formed to be curved. Through this, a paper media transfer device may have a simple structure. It is possible to improve a productivity and the convenience of maintenance and repair.

Also, according to embodiments of the present invention, it is possible to match an end surface of a guide rib of a medium guide portion and a contact surface of a belt of a medium transfer portion. Through this, it is possible to improve a tightening force given to paper media by an edge of the guide rib and an edge of the belt.

Also, according to embodiments of the present invention, a guide rib of a medium guide portion may be provided on each of both sides of a belt. Therefore, it is possible to increase a portion for giving a frictional force to paper media and thereby to effectively transfer even a half size of paper media.

BEST MODE FOR CARRYING OUT THE INVENTION

Figure 1:
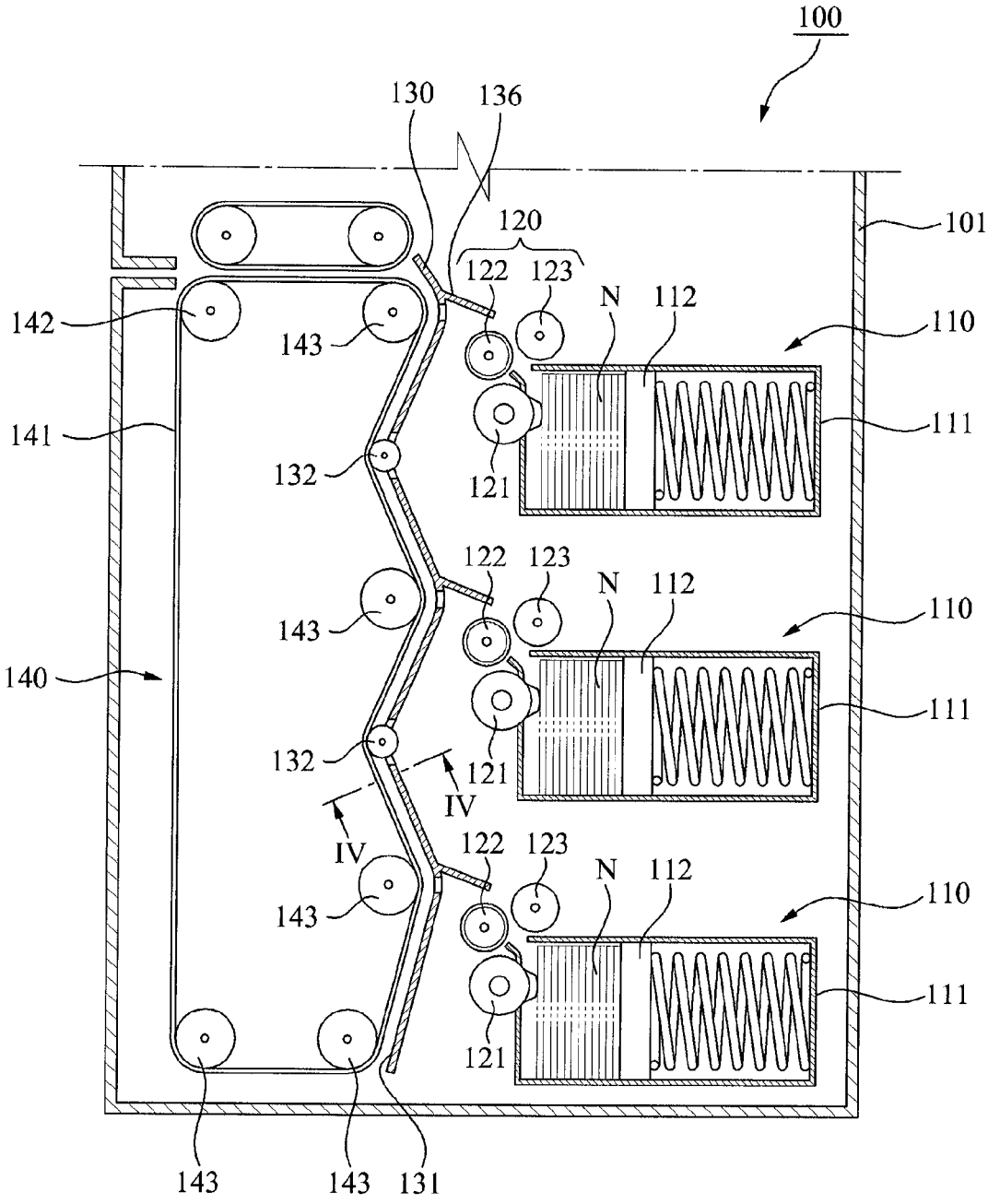
FIG. 1 is a cross-sectional view illustrating a portion of an automatic teller machine according to an embodiment of the present invention.

Reference will now be made in detail to embodiments of the present invention, examples of which are illustrated in the accompanying drawings, wherein like reference numerals refer to the like elements throughout. The embodiments are described below in order to explain the present invention by referring to the figures.

The following explanation is one of various aspects of the present invention and the following description constitutes a portion of detailed description of the present invention.

Here, when describing the present invention, detailed description regarding a known function or configuration will be omitted to clarify the present invention.

Figure 2:
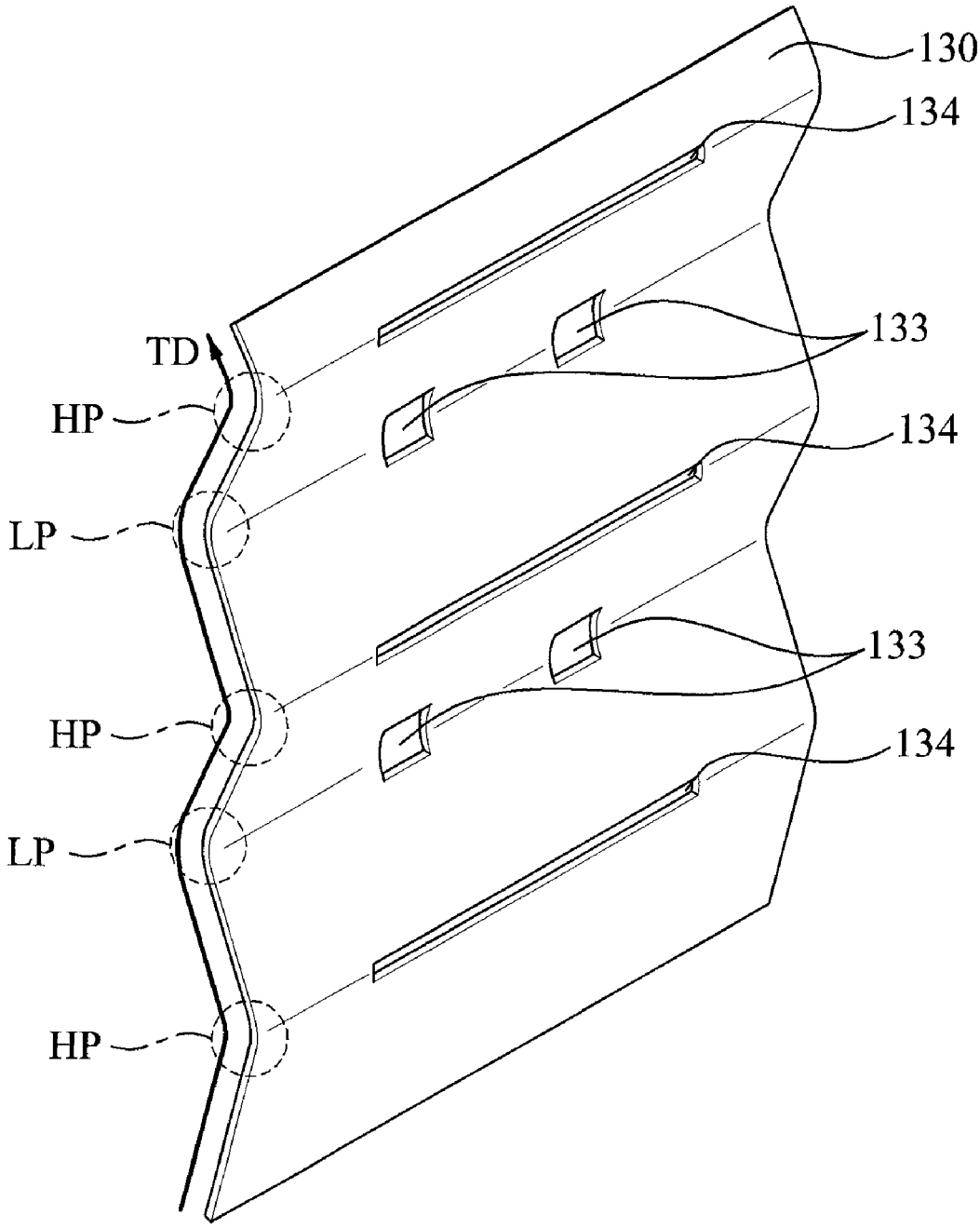
FIG. 2 is a perspective view illustrating a medium guide portion of FIG. 1.
Figure 3:
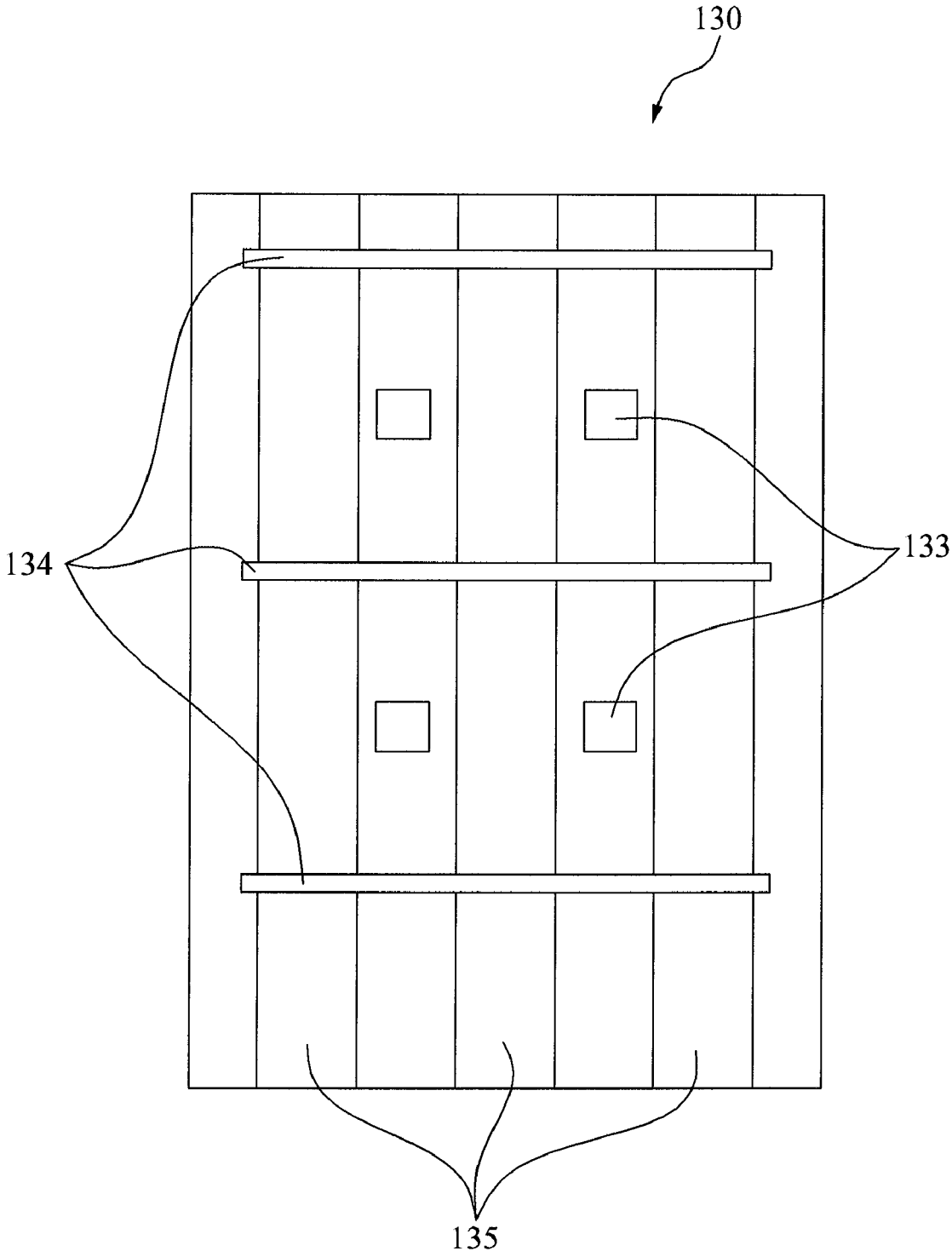
FIG. 3 is a plane view illustrating one surface of the medium guide portion of FIG. 1 facing a medium transfer portion of FIG. 1.
Figure 4:
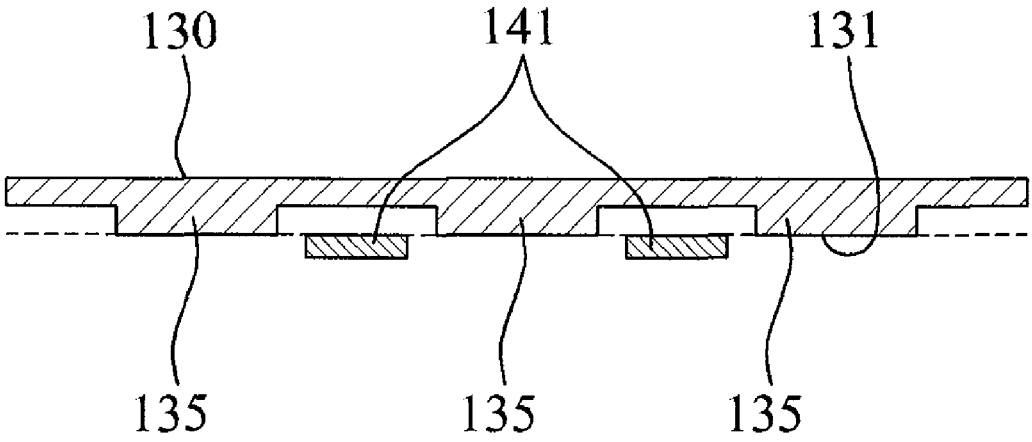
FIG. 4 is a cross-sectional view cut along a line IV-IV of FIG. 1.

FIG. 1 is a cross-sectional view illustrating a portion of an automatic teller machine 100 according to an embodiment of the present invention, FIG. 2 is a perspective view illustrating a medium guide portion 130 of FIG. 1, FIG. 3 is a plane view illustrating one surface of the medium guide portion of FIG. 1 facing a medium transfer portion 140 of FIG. 1, and FIG. 4 is a cross-sectional view cut along a line IV-IV of FIG. 1.

As shown in FIG. 1, the automatic teller machine 100 includes a body 101 that forms an external case, a paper media storage device 110 that is detachably provided in the body 101 to receive paper media N, a medium separation device 120 that separates, for example, picks up the paper media N in a sheet unit, and a paper media transfer device that transfers the separated paper media N. The paper media transfer device may include the medium guide portion 130 and the medium transfer portion 140.

Here, the paper media storage device 110 includes a cassette 111 that internally includes a reception space receiving the paper media and is in a square shape, and a push plate 112 that pushes the paper media N stored in the cassette 111.

A front edge portion of the cassette 111 is open and the paper media N may be received, or discharged via the open portion. In this instance, the paper media N may need to be separated or picked up in the sheet unit. For this, the medium separation unit 120 may need to be provided in the body 101.

The medium separation device 120 may be provided as an external-type separation module by including a pickup roller 121 that induces a sheet-based separation of the paper media N towards an upper portion of the paper media storage device 110, a feed roller 122 that transfers the separated paper media N, and a gate roller 123 that is overlapped with an outer circumferential portion of the feed roller 122 to thereby prevent the separation of double sheets of the paper media N.

Specifically, the medium separation device 120 may be provided in the body 101 of the automatic teller machine 100 to be separated from the cassette 111, instead of being mounted to the cassette 111. Therefore, it is possible to reduce a manufacturing cost of the automatic teller machine 100. In the present embodiment, the medium separation device 120 is provided outside of the paper media storage device 110, but the present invention is not limited thereto. Depending on embodiments, the medium separation device 120 may be provided in the paper media storage device 110.

Here, a separation direction of the paper media N is important. When the paper media N is separated towards a lower portion of the paper media storage device 110, an internal space utilization of the body 101 may be deteriorated. In order to separate a paper media N stored in the cassette 111 provided in a bottom portion in the body 101 in a state where the paper media N is neither crumpled nor folded, a sufficient space may need to be secured in the lower portion of the cassette 111.

Conversely, when the paper media N is separated towards an upper portion of the paper media storage device 110, the cassette 111 provided in a bottom portion of the body 101 may have the same separation structure as the cassette provided in a top portion of the body 101.

Also, by using a stepping motor as a drive source of the pickup roller 121, even when the paper media N is separated in double sheets, the double sheets may be effectively removed by controlling the operating state of the stepping motor.

Hereinafter, the paper media transfer device that transfers the separated paper media N will be described in detail.

The paper media transfer device includes the medium guide portion 130 that is provided on one side of a transfer direction of the paper media N, and includes a guide surface 131 having at least one high point and at least one low point along the transfer direction of the paper media N, and the medium transfer portion 140 that forms a transfer path of the paper media N together with the medium guide portion 130 to transfer the paper media N. Here, a phase of the transfer path may be configured to change along the transfer direction of the paper media N.

As described above, the moving medium transfer portion 140 may be provided on one side of the paper media N, and the motionless medium guide portion 130 may be provided on another side of the paper media N, based on the paper media N. Through this, there is no need to use a plurality of belts and rollers. It is possible to simplify a structure of the paper media transfer device, and to improve a productivity.

Also, the medium guide portion 130 and the medium transfer portion 140 are constructed to have the plurality of high points and the plurality of low points along the transfer direction of the paper media N, whereby it is possible to change the phase of the transfer path. Specifically, in comparison to a case where the transfer path is even, it is possible to increase a tightening force and to prevent the paper media N from being torn or being crumpled. Also, it is possible to prevent the paper media N from being jammed.

Also, a paper media path guide portion 136 may be provided in order to guide the paper media N to the transfer path of the paper media N formed between the medium guide portion 130 and the medium transfer portion 140 in a state where a path of the paper media N is maintained at a predetermined angle by the feed roller 122 and the gate roller 123 of the media separation device 120.

Here, the paper media path guide portion 136 may be provided on one side of a paper media inlet 134 formed in each of the high points of the medium guide portion 130, which will be described later.

FIG. 2 illustrates the medium guide portion 130. The paper media N may be transferred along a bottom surface of the medium guide portion 130. Here, FIG. 2 is a view illustrating the medium guide portion 130 from view of a top surface thereof, that is, from an opposite side of the medium transfer portion 140. The paper media path guide portion 136 of FIG. 1 is not shown in FIG. 2.

As shown in FIG. 2, the paper media N may be transferred along the bottom surface of the medium guide portion 130. In this instance, a plurality of high points HPs and a plurality of low points LPs are formed along a transfer direction TD of the paper media N.

The paper media inlet 134 is provided in each of the high points HPs of the medium guide portion 130. Through this, a distance between the medium separation device 120 and the transfer path may be constructed to be as short as possible.

Also, an entrance angle of the paper media N may be maintained. The entrance angle may be less than 20 degrees in order to prevent the paper media N from being crumpled or being jammed.

A plurality of idler reception portions 133 may be provided in each of the low points LPs of the medium guide portion 130. A plurality of idlers 132 may be mounted to the plurality of idler reception portions 133, respectively, to thereby maintain a transfer force for the paper media N.

As described above, by providing the plurality of idlers 132 and the plurality of idler reception portions 133 in or around each of the low point LP of the medium guide portion 130, it is possible to prevent the paper media N from being crumpled or being jammed even when a phase of the transfer path of the paper media N changes.

The medium guide portion 130 may be formed of a single plate. Each of the idler reception portions 133 may be a groove or a hole formed in the plate.

Depending on embodiments, the medium guide portion 130 may be formed of a plurality of plates. A gap formed between the plurality of plates may be used as the idler reception portion 133 or the paper media inlet 134. Through this, it is possible to omit a process of manufacturing the idler reception 133 or the paper media inlet 134.

Also, the medium guide portion 130 may have a curved shape having the low points LPs and the high points HPs. Also, the medium guide portion 130 may be formed in various types of shapes, for example, a trapezoid shape, an uneven wave shape, and the like.

As shown in FIG. 1, the medium transfer portion 140 may include a belt member 141 that is curved several times along the transfer direction of the paper media N, and a plurality of belt rollers 142 and 143 that drives the belt member 141. Here, the belt rollers 142 and 143 may function to maintain the curved shape of the belt member 141, or to give a tension to the belt member 141.

Also, at least one of the belt rollers 142 and 143, for example, the belt roller 142 may be connected to a transfer motor (not shown) to function as a drive roller.

As described above, among constituent components of the transfer path, only the medium transfer portion 140 may move and the medium guide portion 130 may be motionless. Therefore, it is possible to constantly maintain a tightening force against the paper media N and to readily change the tightening force. In addition, it is possible to simplify a configuration of the paper media transfer device.

In this instance, it may be effective that the belt member 141 has a shape corresponding to the curved shape of the medium guide portion 130. When the belt member 141 and the medium guide portion 130 have the same shape, the transfer path may be uniformly maintained. Also, in comparison to the flat transfer path, it is possible to improve the tightening force.

At least one of the belt rollers 142 and 143 may be driven by the stepping motor, but the present invention is not limited thereto. The stepping motor may rotate at each certain angle according to digital signals and thus may readily cope with the situation where the paper media N is torn or is jammed.

Depending on embodiments, a separate motor may be connected to the idler 132 and thereby improve a transfer force or a transfer speed.

Also, it may be effective that the belt member 141 uses at least two rows of belts that are spaced apart from each other. When only a single row of belt is used, the paper media N may be transferred in a skewed state.

Referring to FIGS. 3 and 4, a plurality of guide ribs 135 may be provided on one surface of the medium guide portion 130, preferably, on the guide surface 131. This is to increase a contact portion between the medium guide portion 130 and the belt 141, and the paper media N.

Through the above construction, the guide rib 135 may be provided on each of both sides of the belt 141. Therefore, even when a half size of paper media N, for example, folded paper media N is being transferred, a frictional force between any one of the belt 141 and the guide rib 135, and the paper media N may be maintains as is and thus, the half size of paper media may be effectively transferred.

Here, the plurality of guide rib 135 may be protruded from the bottom surface of the medium guide portion 130, that is, from the guide surface 131, but the present invention is not limited thereto. Specifically, the same effect may be obtained by forming a plurality of grooves in the bottom surface of the medium guide portion 130.

The plurality of guide ribs 135 may be provided along a moving direction or a lengthwise direction of the belts 141 to be positioned between the belts 141. Specifically, as shown in FIG. 3, the plurality of guide ribs 135 may be provided along a lengthwise direction of the medium guide portion 130 based on the idler reception portion 133 where the idler 132 making a contact with the belt 141 is exposed.

Here, one surface of the belt 141 may form the same surface as a surface that connects end surfaces of the guide ribs 135. Specifically, a line or the surface connecting the end surfaces of the guide ribs 135 may match the contact surface of the belt 141.

Accordingly, an edge of the guide rib 135 and an edge of the belt 141 may increase a force given to the paper media N and may improve a tightening force.

Specifically, when the paper media N passes through a space formed between the edge of the guide rib 135 and the edge of the belt 141, the paper media N may be in an approximate wave shape. By making the end surface of the guide rib 135 and the contact surface of the belt 141 form the straight line or the same surface, it is possible to increase the force given to the paper media N by the edge of the guide rib 135 and the edge of the belt 141.

Also, even when the folded paper media N or the half size of paper media N is being transferred, a gap may be formed between the edge of the guide rib 135 and the edge of the belt 141. Therefore, it is possible to prevent the folded paper media N or the half size of paper media N from being completely stuck between the medium guide portion 130 and the belt 141. Accordingly, even the folded paper media or the half size of paper media may be transferred to a retrieval box or a retracting box (not shown).

When the end surface of the guide rib 135 and the contact surface of the belt 141 are separated from each other, the tightening force given to the paper media N may be deteriorated. Conversely, when the end surface of the guide rib 135 and the contact surface of the belt 141 are overlapped with each other, the tightening force may significantly increase, thereby causing the paper media N to be jammed, and the like.

Hereinafter, an operating principle of the automatic teller machine 100 including the paper media transfer device constructed as above will be described.

When a withdrawal signal of the paper media N is input, the paper media N may be separated in a sheet unit by the medium separation device 120. The separated paper media N may be received in the transfer path formed between the belt 141 and the medium guide portion 130 via the paper media inlet 134.

The above paper media N may be transferred by the tightening force occurring due to the edge of the guide ribs 135 of the medium guide portion 130 and the edge of the belts 141, and by the tightening force occurring due to the curved shape of the medium guide portion 130 and the medium transfer portion 140.

The aforementioned paper media transfer device and automatic teller machine having the paper media transfer device may need to be understood as a technical spirit of the invention or a minimum technology for the invention that can be comprehended from various types of aspects, and thus may not be understood as a boundary limiting the invention.

Although a few embodiments of the present invention have been shown and described, the present invention is not limited to the described embodiments. Instead, it would be appreciated by those skilled in the art that changes may be made to these embodiments without departing from the principles and spirit of the invention, the scope of which is defined by the claims and their equivalents.

The invention claimed is:

1. A paper media transfer device comprising:

a medium guide portion on one side of a transfer direction of the paper media, and including a guide surface having at least one crest and at least one trough along the transfer direction of the paper media; and a medium transfer portion forming a transfer path of the paper media together with the medium guide portion to transfer the paper media, and including:

a belt member that is curved in correspondence to the guide surface, and a belt roller that drives the belt member and maintains the curved shape of the belt member, or adds a tension to the belt member;

wherein the medium guide portion includes a paper media inlet to receive the paper media between the medium transfer portion and the medium guide portion.

2. The paper media transfer device of claim 1, wherein the belt member comprises at least two rows of belts that are spaced apart from each other, and a plurality of guide ribs is formed on one surface of the medium guide portion along a moving direction of the belts to thereby be positioned between the belts, and the one surface of the medium guide portion faces the belt.

3. The paper media transfer device of claim 1, wherein one surface of the belt member coming into contact with the paper media forms the same surface as the surface that connects end surfaces of the guide ribs.

4. The paper media transfer device of claim 1, wherein the medium guide portion comprises:

a plurality of idler reception portions in a portion corresponding to each of the at least one trough along the transfer direction of the paper media; and a plurality of idlers, each mounted to one of the plurality of idler reception portions.

5. The paper media transfer device of claim 1, wherein the medium guide portion is formed of a single plate, and each of the idler reception portions is a groove or a hole formed in the plate.

6. The paper media transfer device of claim 1, wherein the medium guide portion is formed of a plurality of plates, and at least one of the idler reception portions and the paper media inlet is formed between the plurality of plates.

7. The paper media transfer device of claim 1, wherein a paper media path guide portion is further provided on one side of the paper media inlet to guide the paper media to the paper media inlet.

* * * * *